US006522843B2

(12) United States Patent
Yamada et al.

(10) Patent No.: US 6,522,843 B2
(45) Date of Patent: Feb. 18, 2003

(54) IMAGE FORMING APPARATUS CAPABLE OF JUDGING WHETHER IT IS APPROPRIATE TO FORM AN IMAGE ON A SHEET AND CONTROLLING THE IMAGE FORMATION ACCORDINGLY

(75) Inventors: Takanobu Yamada, Osaka (JP); Seiichi Munemori, Osaka (JP); Yuusuke Morikami, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/879,093

(22) Filed: Jun. 13, 2001

(65) Prior Publication Data

US 2001/0053294 A1 Dec. 20, 2001

(30) Foreign Application Priority Data

Jun. 15, 2000 (JP) ..... 2000-179803

(51) Int. Cl.[7] ..... G03G 15/16

(52) U.S. Cl. ..... 399/66; 399/67; 399/302; 399/308; 399/394

(58) Field of Search ..... 399/66, 67, 68, 399/69, 297, 298, 301, 302, 308, 388, 389, 394, 18, 21, 23

(56) References Cited

U.S. PATENT DOCUMENTS 5,333,038 A * 7/1994 Mizoguchi et al. ..... 399/46
6,154,621 A * 11/2000 Yamamoto et al. ..... 399/68
6,192,205 B1 * 2/2001 Motohashi ..... 399/66
6,285,849 B1 * 9/2001 Shimada et al. ..... 399/301

FOREIGN PATENT DOCUMENTS

JP 7-28294 1/1995

* cited by examiner

*Primary Examiner*—Hoan Tran
(74) *Attorney, Agent, or Firm*—Morrison & Foerster LLP

(57) ABSTRACT

When it is judged that a sheet S is not an ordinary paper but a thick paper or an OHP film sheet, or that the arrival of the sheet S at a pair of timing rollers 48 is delayed due to a slip for example beyond an allowable period of time, a controller 70 judges that a condition for transferring or fixing an image on the sheet S is not met. As a result, a secondary transfer roller 34 and a cleaner 38 are retreated from an intermediate transfer belt 12, and in this state, the intermediate transfer belt 12 carrying a toner image I thereon is made idle at least about one revolution without transferring the image I.

13 Claims, 8 Drawing Sheets

IMAGE FORMING APPARATUS CAPABLE OF JUDGING WHETHER IT IS APPROPRIATE TO FORM AN IMAGE ON A SHEET AND CONTROLLING THE IMAGE FORMATION ACCORDINGLY

This application is based on application No. 2000-179803 filed in Japan, the content of which is hereby incorporated by reference.

BACKGROUND OF THE INVENTION

1. Field of the invention

The present invention relates to a color image forming apparatus and more particularly to an image forming apparatus such as a printer, a copying machine, a facsimile machine and a multi function printer in which a toner image is formed on an intermediate transfer member and then transferred to a recording medium such as a paper or an OHP film sheet (i.e., a film sheet for an overhead projector).

2. Description of the Related Art

A so-called tandem-type color image forming apparatus is conventionally known in which a plurality of image forming units storing toners of different colors are arranged along an intermediate transfer belt, as disclosed in Japanese laid-open Patent Application No. HEI 7-28294.

With such an image forming apparatus, images of respective colors are formed, one upon another, on the intermediate transfer belt by respective image forming units, and the resulting composite color image is transferred onto a sheet. The sheet is subsequently transported through a fixing unit for thermally fixing the image on the sheet. Thereafter, the sheet is discharged to a discharged sheet tray.

In the above-described prior art image forming apparatus, the feeding of a sheet on which an image is to be transferred may be delayed, due to a slip for example, relative to the image formed on the intermediate transfer belt in the respective image forming units, so that the sheet may not be transported in time for the transferring of the image. In such a case, the operation of the apparatus is compulsorily interrupted so that the sheet, which is on the way of transportation, is removed by the user, and the toner image on the intermediate transfer belt is removed by scraping off the toners.

With such a method, however, the interruption of the operation greatly deteriorates the image forming productivity. Moreover, the toners having formed the removed toner image as well as the sheet removed on the way of transportation are wasted if they are not reused.

Further, if a sheet of thick paper or OHP film sheet is fed in spite of a printing instruction for an ordinary sheet and the image fixing is performed on the same condition as for an ordinary sheet, heat is greatly absorbed by the sheet itself. As a result, the fixing of the image becomes insufficient, so that it is impossible to obtain an image having good color development.

SUMMARY OF THE INVENTION

It is, therefore, an object of the present invention to provide an image forming apparatus which is capable of continuing the image forming operation even when the feeding of a sheet is delayed relative to an image on the intermediate transfer belt.

Another object of the present invention is to provide an image forming apparatus which is capable of sufficiently fixing an image and providing an image of good color development.

For accomplishing the above-described objects, an image forming apparatus in accordance with the present invention comprises: a rotatable intermediate transfer member; an image forming device for forming a toner image of a different color images on the intermediate transfer member; a transferring device for transferring the toner image formed on the intermediate transfer member onto a sheet; a fixing device for fixing the toner image transferred on the sheet to the sheet; and an image forming operation controller for judging whether or not a condition for transferring or fixing an image on the sheet is met and for controlling an image forming operation based on the judgment.

According to another aspect of the present invention, an image forming apparatus, comprises: a rotatable intermediate transfer belt; a plurality of image forming units each for forming an image of a different color on the intermediate transfer belt, the units being arranged along the intermediate transfer belt; a transferring device for transferring the image formed on the intermediate transfer belt onto a recording medium; and a controller for judging whether or not a condition for transferring an image on the recording medium is met and for controlling an image forming operation based on the judgement.

BRIEF DESCRIPTION OF THE DRAWINGS

These and other objects and features of this invention will become clear from the following description, taken in conjunction with the preferred embodiments with reference to the accompanied drawings in which.

DETAILED DESCRIPTION OF THE PREFERRED EMBODIMENT

Figure 1:
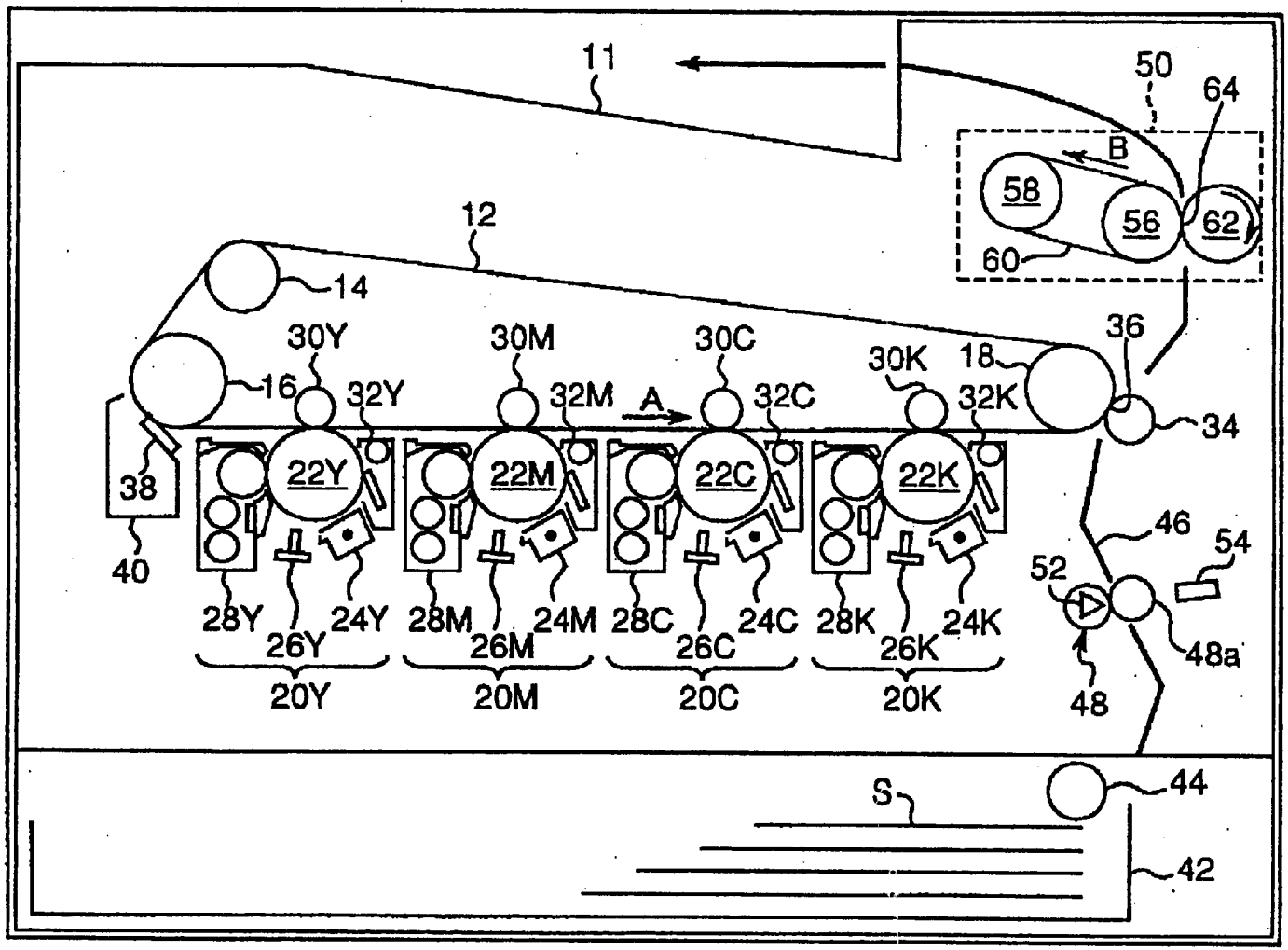
FIG. 1 illustrates the general structure of a printer.

Preferred embodiments of the present invention will be described below with reference to the accompanying drawings. FIG. 1 schematically illustrates the structure of a tandem-type digital color printer (hereinafter simply referred to as a printer) 10 in accordance with a first embodiment of the present invention.

The printer 10 includes, at a generally central portion thereof, an intermediate transfer belt 12 as an intermediate transfer member. The intermediate transfer belt 12 is driven for rotation in the direction indicated by an arrow A while being carried by outer circumferential portions of three rollers 14, 16 and 18.

Four image forming units 20Y, 20M, 20C and 20K for respectively forming a toner image of the corresponding color of yellow (Y), magenta (M), cyan (C) and black (K) are arranged along the intermediate transfer belt 12 below a lower horizontal portion thereof.

The image forming units 20Y, 20M, 20C and 20K include photosensitive drums 22Y, 22M, 22C and 22K, respectively. Each of the image forming units 20Y, 20M, 20C, and 20K further includes, around the corresponding photosensitive drum 22Y, 22M, 22C, and 22K along its rotational direction, a charging device 24Y, 24M, 24C and 24K, a printhead section 26Y, 26M, 26C and 26K, a developer 28Y, 28M, 28C and 28K, a primary transfer roller 30Y, 30M, 30C and 30K disposed in facing relationship to the corresponding photosensitive drum 22Y, 22M, 22C, and 22K via the intermediate transfer belt 12, and a cleaner 32Y, 32M, 32C and 32K.

Each of the charging devices 24Y, 24M, 24C, and 24K uniformly charges a surface of the corresponding photosensitive drum 22Y, 22M, 22C and 22K. Each of the printhead sections 26Y, 26M, 26C and 26K exposes the uniformly charged surface of the corresponding photosensitive drum 22Y, 22M, 22C and 22K to light in accordance with the image data for the color, thereby forming an electrostatic latent image. Each of the developers 28Y, 28M, 28C, and 28K develops the electrostatic latent image formed on the surface of the corresponding photosensitive drum 22Y, 22M, 22C and 22K into a toner image. Each of the primary transfer rollers 30Y, 30M, 30C and 30K electrostatically attracts the toner image formed on the corresponding photosensitive drum 22Y, 22M, 22C and 22K to primarily transfer the image on the intermediate transfer belt 12. Each of the cleaners 32Y, 32M, 32C and 32K cleans the corresponding photosensitive drum 22Y, 22M, 22C and 22K by removing toners remaining on the surface of the drum after the primary transfer. Each of the printhead section 26Y, 26M, 26C, and 26K comprises a multiplicity of LEDs aligned in a primary scanning direction extending in parallel with the axis of the photosensitive drum.

There is also provided a secondary transfer roller 34 which is pressed against a portion of the intermediate transfer belt 12 carried by the roller 18. A nip defined between the secondary transfer roller 34 and the intermediate transfer belt 12 serves as a transfer region 36. By the provision of a secondary transfer roller retreating mechanism 84, the secondary transfer roller 34 is movable to retreat to a position out of contact with the intermediate transfer belt 12. A high voltage is applied across the secondary transfer roller 34 to electrostatically attract a toner image formed on the intermediate transfer belt 12 onto a sheet which is transported to the transfer region 36, which will be described later.

A cleaner 38 is pressed against a portion of the intermediate transfer belt 12 carried by the roller 16. The cleaner 38 is provided for raking up the toners remaining on the intermediate transfer belt 12 after the secondary transfer and collecting the toners in a waste toner box 40. Similarly to the secondary transfer roller 34, the cleaner 38 is also movable to retreat to a position out of contact with the intermediate transfer belt 12 by the provision of a cleaner retreating mechanism 85.

Figure 9:
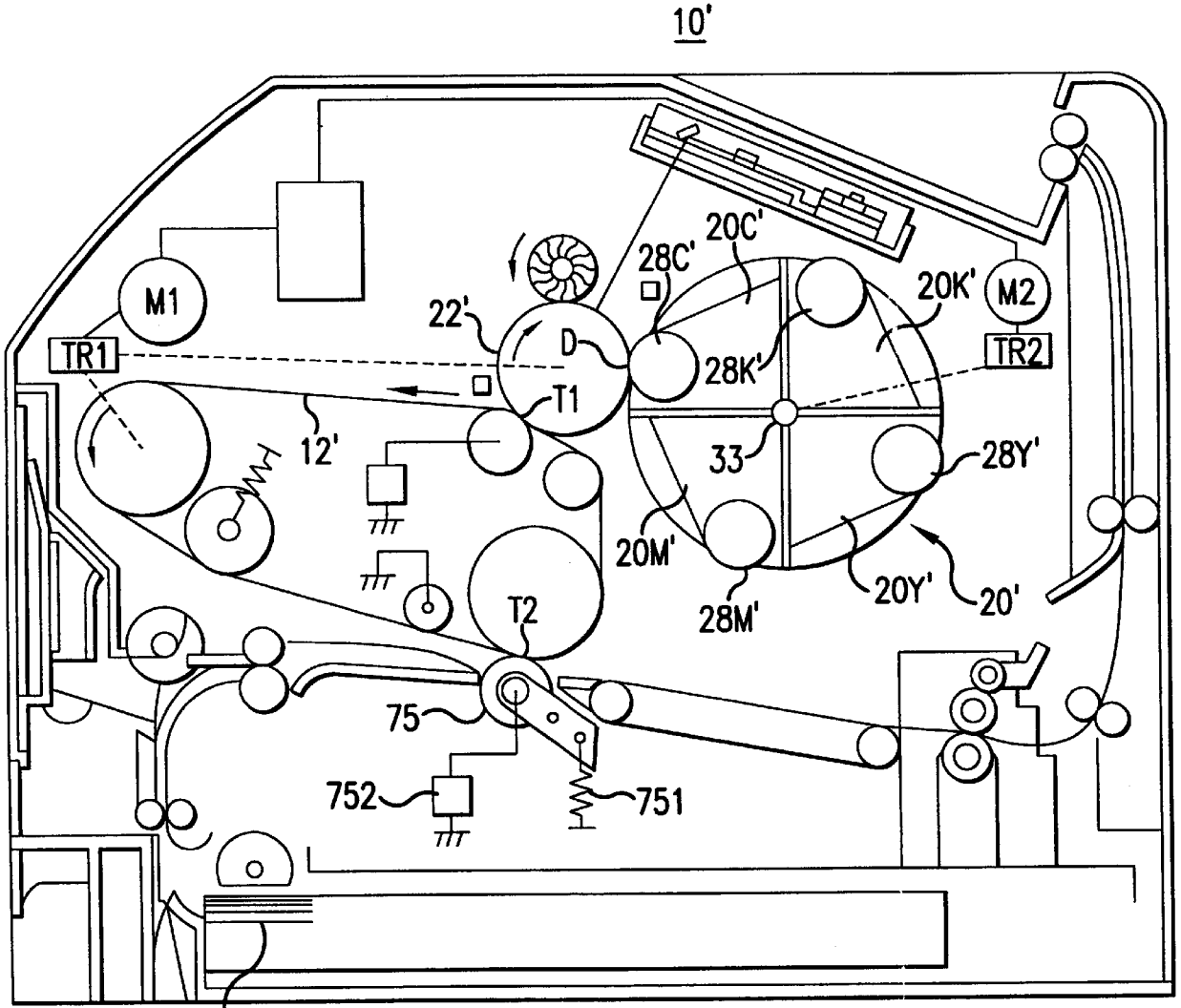
FIG. 9 illustrates the general structure of a printer utilizing a rotary shifting developing device.

For example, as shown in FIG. 9, the secondary transfer roller retreating mechanism 84 and the cleaner retreating mechanism 85 may utilize a lever on one end which the secondary transfer roller or the cleaner is disposed and on the other end of which a pressure spring is disposed, so that the secondary transfer roller and the cleaner are movable into and out of contact with the intermediate transfer belt.

A sheet cassette 42 is removably mounted at a lower portion of the printer 10. Sheets S stacked in the sheet cassette 42 are fed, one by one, to a transport path 46 by the rotation of a sheet feeding roller 44.

The transport path 46 extends from the sheet cassette 42 through a nip between a pair of timing rollers 48, the secondary transfer region 36 and a fixing unit 50 to a discharged sheet tray 11. The paired timing rollers 48 are provided for transporting a sheet fed from the sheet cassette 42 to the transfer region 36 in synchronism with an image on the intermediate transfer belt 12.

A timing sensor 52 is disposed adjacent the paired timing rollers 48. The timing sensor 52 is provided to detect that the leading edge of a sheet S fed from the sheet cassette 42 to the transport path 46 is nipped in the paired timing rollers 48. When the timing sensor 52 detects the leading edge of a sheet S, the paired timing rollers 48 once stop the rotation, and thereafter, in synchronism with a toner image on the intermediate transfer belt 12, transport the sheet S to the transfer region 36. Herein, the distance between a primary transfer region provided by the primary transfer roller 30K and the second transfer region 36 is made longer than the distance between the nip of the paired timing rollers 48 and the second transfer region 36.

A sheet thickness sensor 54 is disposed in facing relationship to one roller 48*a* of the pair of timing rollers 48. The sheet thickness sensor 54 detects the amount of movement of the roller 48*a* when the leading edge of the sheet S is nipped between the paired timing rollers 48. Thus, it is possible to judge whether the sheet comprises an ordinary paper, or a thick paper or an OHP film sheet having a larger thickness than that of an ordinary paper.

The fixing unit 50 includes a pair of rollers 56, 58, a fixing belt 60 carried around the rollers 56, 58 for rotation in the direction indicated by an arrow B, and a fixing roller 62 pressed against the roller 56 via the fixing belt 60 to be driven for rotation in an arrow direction. A nip defined between the fixing belt 60 and the fixing roller 62 through which the sheet on which the toner image is secondarily transferred passes serves as a fixing region 64. The fixing belt 60 is heated by a heater (not shown).

Figure 2:
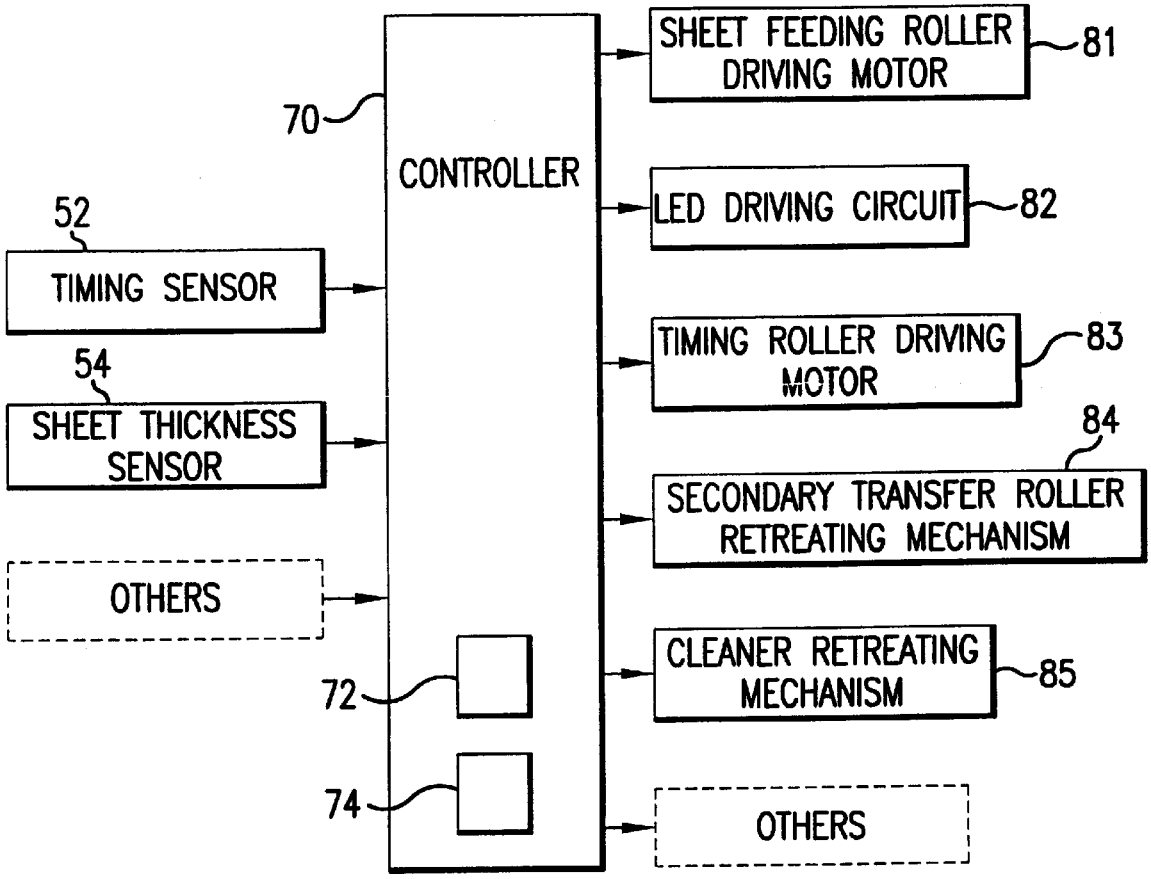
FIG. 2 is a block diagram showing a schematic constitution of a controller.

As shown in FIG. 2, the printer includes a controller 70 for judging image forming conditions and for controlling the image forming operation. The controller 70 includes a exposure and sheet-feed timer 72 and a sheet-feed slip watching timer 74. In forming a color image, the exposure and sheet-feed timer 72 counts time from the starting of light exposure at the image forming unit 20Y to the starting of the sheet feeding by the sheet feeding roller 44. In forming a monochromatic image, the exposure and sheet-feed timer 72 counts time from the starting of light exposure at the image forming unit 20K to the starting of the sheet feeding by the sheet feeding roller 44. The sheet feed slip watch timer 74 counts time from the starting of the driving of the sheet feeding roller 44, when a sheet is fed, without slipping, from the sheet cassette 42, to the detecting of the leading edge of the sheet by the timing sensor 52 to which allowable slip time is added.

Signals from the timing sensor 52 and the sheet thickness sensor 54 and the like are input to the controller 70. The controller outputs signals to a sheet feeding roller driving motor 81, an LED driving circuit 82, a timing roller driving motor 83, the secondary transfer roller retreating mechanism 84, the cleaner retreating mechanism 85 and the like. The controller 70 further has the function of sequentially detecting, based on the time elapsed from signal output to the LED drive circuit, i.e., from the driving of the printhead sections 26Y to 26K, the position of a toner image on the intermediate transfer belt 12 moving at a predetermined system speed.

To be described next is the operation of the printer 10 having the above-described structure.

When image signals are input from an external device such as a personal computer to an image signal processing unit (not shown) in the printer 10, the image signal processing unit converts the signals to digital image signals for respective colors of yellow, cyan, magenta and black, and transmits the signals to a printhead LED drive circuit. Based on thus input digital signals, the drive circuit drives the printhead sections 26Y, 26M, 26C and 26K of the image forming unit 20Y, 20M, 20C and 20K to emit light for performing light exposure. The light exposure operation is performed sequentially at respective printhead sections 26Y, 26M, 26C and 26K at predetermined intervals. As a result, electrostatic latent images for respective colors are formed on the surfaces of the photosensitive drums 22Y, 22M, 22C and 22K.

The electrostatic latent images respectively formed on the photosensitive drums 22Y, 22M, 22C and 22K are developed by the developer 28Y, 28M, 28C and 28K into toner images for respective colors. Then, by the operation of the primary transfer rollers 30Y, 30M, 30C and 30K, the toner images for respective colors are primarily transferred, with one superimposed upon another, onto the intermediate transfer belt 12 moving in the direction of the arrow A.

The superimposed, or composite color toner image thus formed on the intermediate transfer belt 12 moves in accordance with the movement of the intermediate transfer belt 12 to reach the transfer region 36. At the transfer region 36, the composite color toner image is secondarily transferred, by the operation of the secondary transfer roller 34, onto a sheet S which is fed from the sheet cassette 42 and transported along the transport path 46 through the pair of timing rollers 48. It is to be noted that toners remaining on the intermediate transfer belt 12 after the secondary transfer are collected by the cleaner 38.

The sheet S on which the toner image is secondarily transferred is advanced along the transport path 46 to the fixing unit 50 and passes through the fixing region 64 provided therein. As a result, the toner image is thermally fixed on the sheet S. Then, the sheet S is discharged to the discharged sheet tray 11.

Unlike the color image forming operation described above, for forming a monochromatic image, only the image forming unit 20K operates based on the monochromatic image data, thereby forming a black toner image on the intermediate transfer belt 12. Thereafter, similarly to the color image forming process, the black toner image is secondarily transferred to the sheet S at the transfer region 36 and thermally fixed on the sheet S in the fixing unit 50. The sheet S is then discharged to the discharged sheet tray 11.

Figure 5:
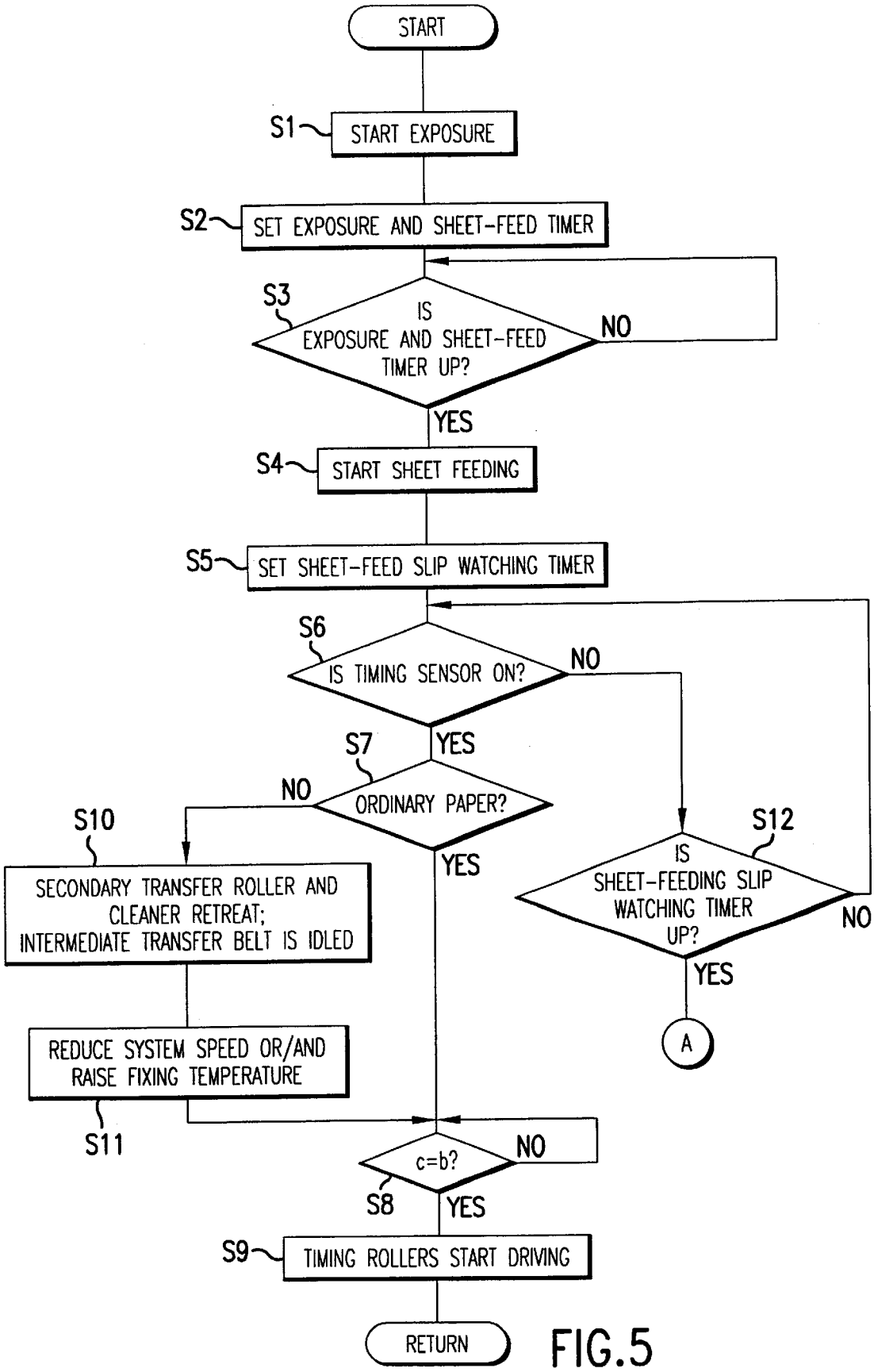
FIG. 5 is a flow chart showing the control operation performed by the controller.

Next, the operation by the controller 70 will be described with reference to flowcharts shown in FIGS. 5 and 6.

When an instruction for forming a color image is given, the controller 70 sequentially starts the light exposure process in each of the image forming units 20Y to 20K, whereas when an instruction for forming a monochromatic image is given, the controller 70 starts the light exposure process in the image forming unit 20K (step S1). And, the exposure and sheet-feed timer 72 is set (step S2). After waiting until the completion of counting by the exposure and sheet-feed timer 72 (step S3), sheet feeding by the sheet feeding roller 44 is started (step S4), and the sheet-feed slip watching timer 74 is set (step S5). Subsequently, it is judged whether the timing sensor 52 is 'on' (i.e., whether the leading edge of a sheet is detected) (step S6). If the sensor is not on, it is judged whether the sheet-feed slip watching timer 74 is 'up', i.e. has completed the counting of time (step S12). If the sheet-feed slip watching timer 74 is not 'up', whether the timing sensor 52 is on is again judged (step S6). In thus repeating the steps S6 and S12, if the timing sensor 52 becomes on before the sheet-feed slip watching timer 74 is 'up', it is judged that the sheet S has reached the paired timing rollers 48 within allowable time without delay.

Figure 4:
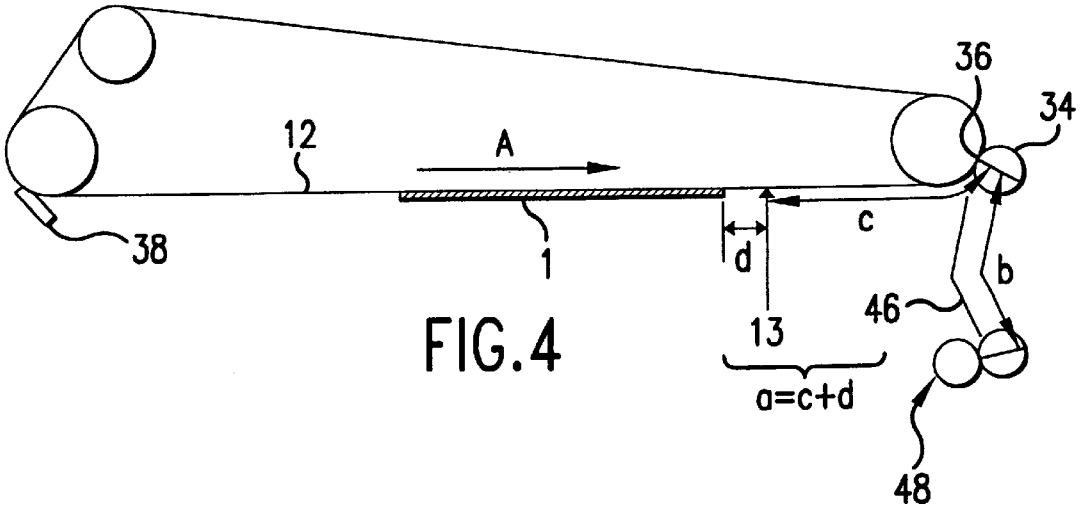
FIG. 4 illustrates the distance between a position on the intermediate transfer belt corresponding to the leading edge of a sheet or the leading edge of the image on the belt and a transfer region, and the distance between the paired timing rollers and the transfer region.

Subsequently, based on signals output from the sheet thickness sensor 54, whether the sheet is an ordinary paper or not is judged (step S7). When the sheet is judged to be an ordinary paper, the controller 70 judges, through the steps S6, S12 and S7, that a condition for transferring and fixing an image on the sheet S is met. Therefore, as shown in FIG. 4, after waiting until a distance c between a position 13 on the intermediate transfer belt 12 which corresponds to the leading edge of the sheet (hereinafter referred to as sheet-edge corresponding position) and the transfer region 36 becomes equal to a distance b between the nip of the paired timing rollers 48 and the transfer region 36 (step S8), the paired timing rollers 48 are started to be driven (step S9). Herein, it is to be noted that the sheet-edge corresponding position 13 is spaced from the leading edge of a toner image I by a distance d which corresponds to a margin on the sheet. Since the traveling of the intermediate transfer belt 12 and the transportation of the sheet by the paired timing rollers 48 are performed at the same system speed, the sheet S is transported to the transfer region 36 in synchronism with the toner image I on the intermediate transfer belt 12. As a result, the toner image is secondarily transferred from the intermediate transfer belt 12 to an appropriate position of the sheet S.

Figure 3A:
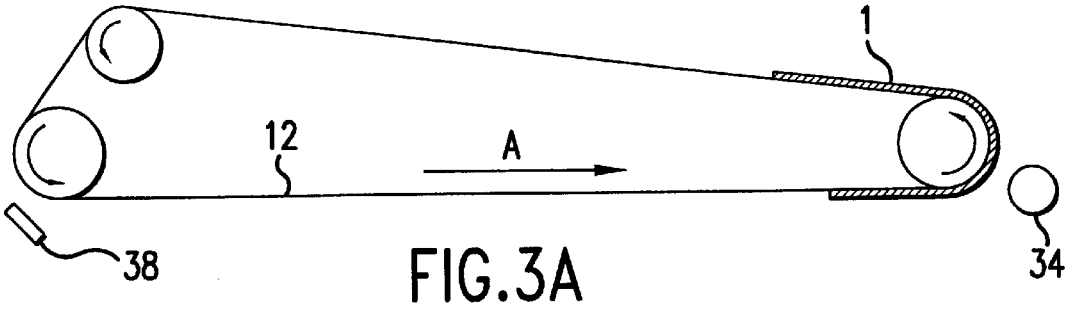
FIG. 3A illustrates a state where an intermediate transfer belt idles with a secondary transfer roller and a cleaner retreated.

On the other hand, if it is judged, in the step S7, that the sheet S is not an ordinary paper but a thick paper or an OHP film sheet, the controller 70 judges that a condition for fixing an image on the sheet S is not met. As a result, as shown in FIG. 3A, the secondary transfer roller 34 and the cleaner 38 are retreated, and the intermediate transfer belt 12 carrying the toner image I thereon is idled at least about one revolution without transferring the toner image I (step S10). During the idling, the rotation speed of the intermediate transfer belt 12 and the speed of the image fixing of the fixing unit 50 (i.e., the rotation speed of the fixing belt 60) are reduced (step S11). With the speed thus reduced, in synchronism with the toner image I on the intermediate transfer belt 12 (step S8), the paired timing rollers 48 are started to be driven (step S9). At this time, the secondary transfer roller 34 and the cleaner 38 recover their original positions. Therefore, the toner image I on the intermediate transfer belt 12 is transferred on the sheet S at the reduced speed and then fixed to the sheet S relatively slowly at the reduced speed. As a result, it is possible to reliably fix the image on the sheet S of a relatively large thickness such as a thick paper or an OHP film sheet, so that an image of good color development can be provided.

Although, in the above-described control operation, the system speed of the intermediate transfer belt 12 and the fixing unit 50 is reduced during the idling of the intermediate transfer belt 12, the temperature for fixing the image in the fixing unit 50 may be also controlled to be raised. Alternatively, only the fixing temperature may be controlled to be raised without reducing the system speed (step S11). Similar advantages can be obtained with this control operation.

Figure 3B:
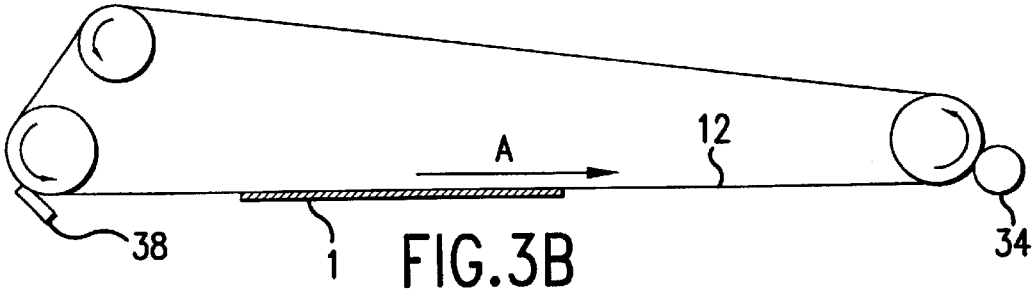
FIG. 3B illustrates a state where the secondary transfer roller and the cleaner recover their original positions.

In the above-described steps S6 and S12, when the sheet-feed slip watching timer 74 is up before the timing sensor 52 becomes on, it is judged that the sheet S is delayed, due to a slip for example, in reaching the paired timing rollers 48 beyond the allowable period of time. Accordingly, the controller 70 judges that a condition for transferring the image on the sheet S is not met. In this case, the secondary transfer roller 34 and the cleaner 38 are retreated from the intermediate transfer belt 12, and the intermediate transfer belt 12 carrying the toner image I thereon is idled at least about one revolution without transferring the toner image I (step S13). Subsequently, when the sheet S reaches the paired timing rollers 48 (step S14), in synchronism with the toner image I on the intermediate transfer belt 12 (step S15), the paired timing rollers 48 are started to be driven (step S16). At this time, the secondary transfer roller 34 and the cleaner 38 recover their original positions as shown in FIG. 3B. Thus, the toner image I on the intermediate transfer belt 12 is transferred at an appropriate position of the sheet S in the transfer region 36.

In this way, with the printer 10 of this embodiment, it is possible to reliably transfer the toner image I on the sheet S even if the feeding of the sheet S is delayed due to a slip for example. Thus, it is possible to continue the image forming operation even under a condition which has conventionally forced the operation of the apparatus to stop. As a result, it is possible to prevent the image forming efficiency to be deteriorated and to prevent the image forming material and sheets from being wasted.

Next, another control operation which may replace the control operation shown in FIG. 6 will be described with reference to flowcharts shown in FIGS. 7 and 8.

If it is judged, through the above-described steps S6 and S12, that, relative to the position of the toner image on the intermediate transfer belt 12, the sheet S is delayed, due to a slip for example, in reaching the paired timing rollers 48 beyond the allowable period of time, the controller judges whether a distance a is longer than a distance b, as shown in FIG. 4, (step S17). Herein, the distance a is the distance between the leading edge of the toner image I and the transfer region 36, which equals to the distance c between the sheet-edge corresponding position 13 and the transfer region 36 plus the distance d corresponding to a margin on the sheet, as shown in FIG. 4. When the distance a is longer than the distance b, the toner image on the intermediate transfer belt 12 can be transferred onto the sheet S without protruding outward of the sheet, although the toner image I is printed at a position slightly deviating from the appropriate position, thereby reducing the margin on the sheet. In this case, therefore, the controller 70 judges that a condition for transferring the image on the sheet S is met.

In this case, as soon as the sheet S reaches the paired timing rollers 48 (step S18), the paired timing rollers 48 are driven (step S19) for transporting the sheet S to the transfer region 36. As a result, the toner image I on the intermediate transfer belt 12 is transferred on the sheet S without protruding outward of the sheet.

On the other hand, when the distance a is equal to or smaller than the distance b in the step S17, the sheet S cannot be transported in time for the image transfer operation even if the paired timing rollers 48 continue to transport the sheet S toward the transfer region 36. In this case, if the toner image I is transferred, it protrudes outward of the sheet S. Therefore, the controller 70 judges that a condition for transferring the image on the sheet S is not met.

In this case, as shown in FIG. 3A, the secondary transfer roller 34 and the cleaner 38 are retreated from the intermediate transfer belt 12, and the intermediate transfer belt 12 carrying the toner image I thereon is idled at least about one revolution without transferring the toner image I (step S20). Subsequently, when the sheet S reaches the paired timing rollers 48 (step S21), in synchronism with the toner image I on the intermediate transfer belt 12 (step S22), the paired timing rollers 48 are started to be driven (step S19). At this time, the secondary transfer roller 34 and the cleaner 38 recover their original positions. Thus, the toner image I on the intermediate transfer belt 12 is transferred at an appropriate position of the sheet S in the transfer region 36.

Also by this control operation, it is possible to reliably transfer the toner image I on the sheet S even if the feeding of the sheet S is delayed due to a slip for example. Thus, it is possible to continue the image forming operation even under a condition which has conventionally forced the operation of the apparatus to stop. As a result, it is possible to prevent the image forming efficiency to be deteriorated and to prevent the image forming material and sheets from being wasted.

Figure 6:
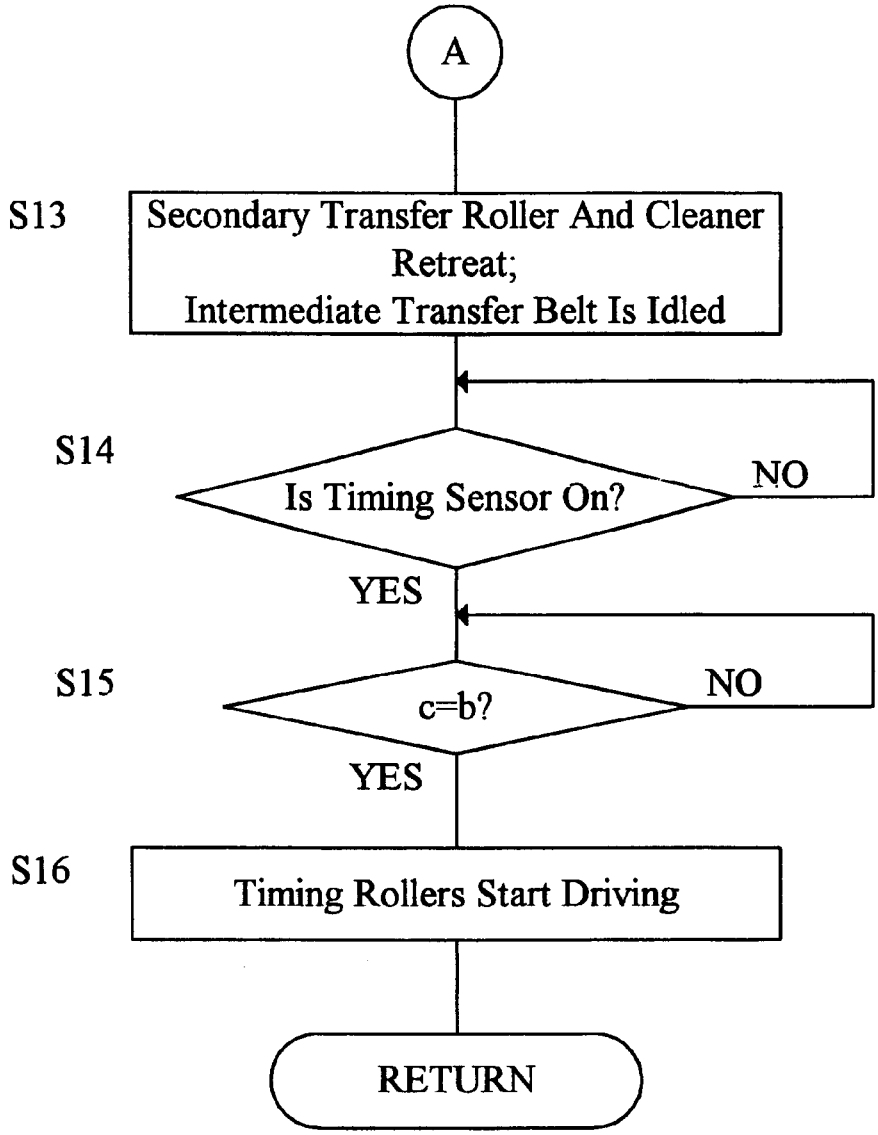
FIG. 6 is a flow chart showing the control operation performed by the controller following the operation shown in FIG. 5.
Figure 7:
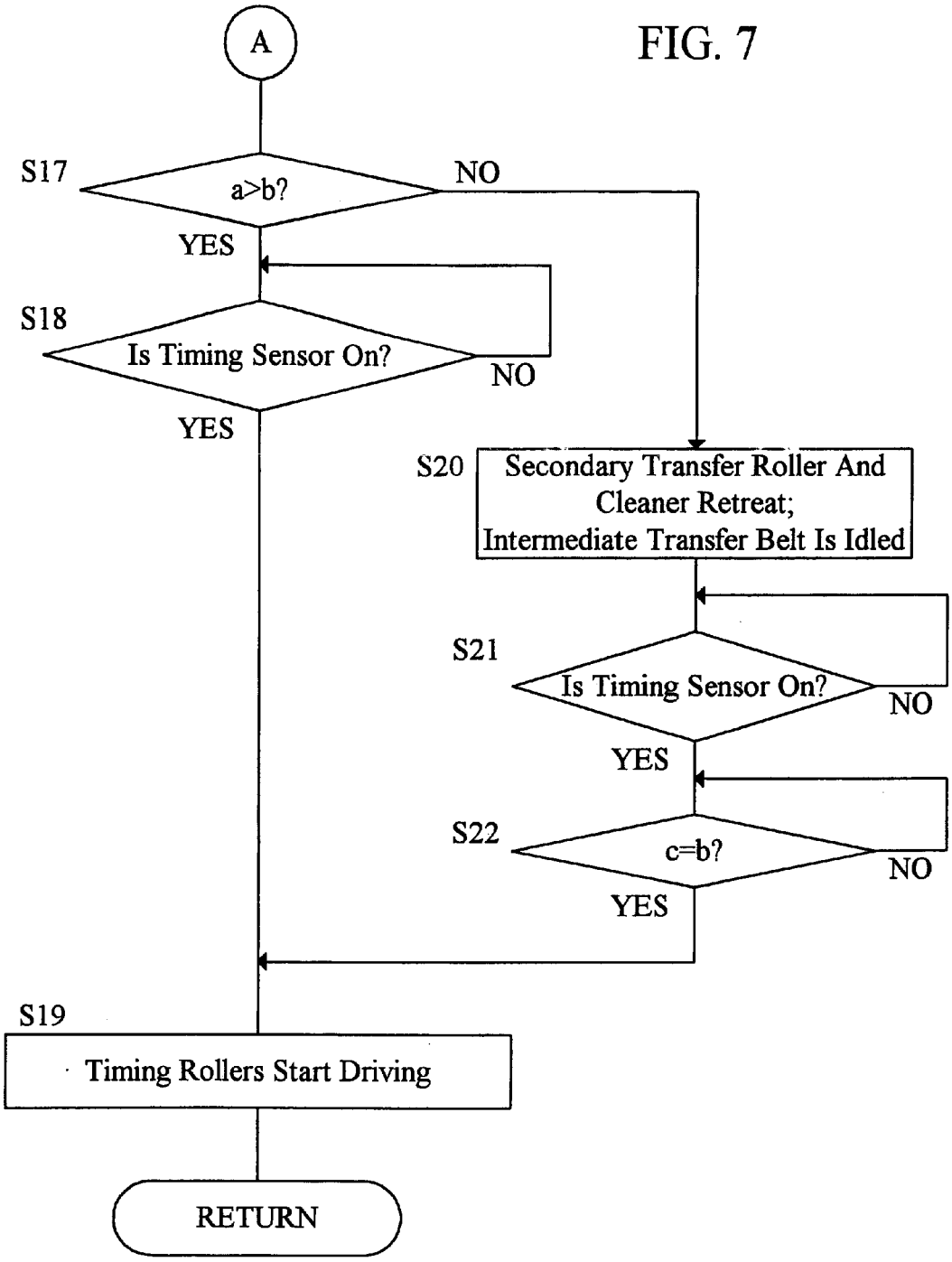
FIG. 7 is a flow chart showing another control operation performed by the controller following the operation shown in FIG. 5.
Figure 8:
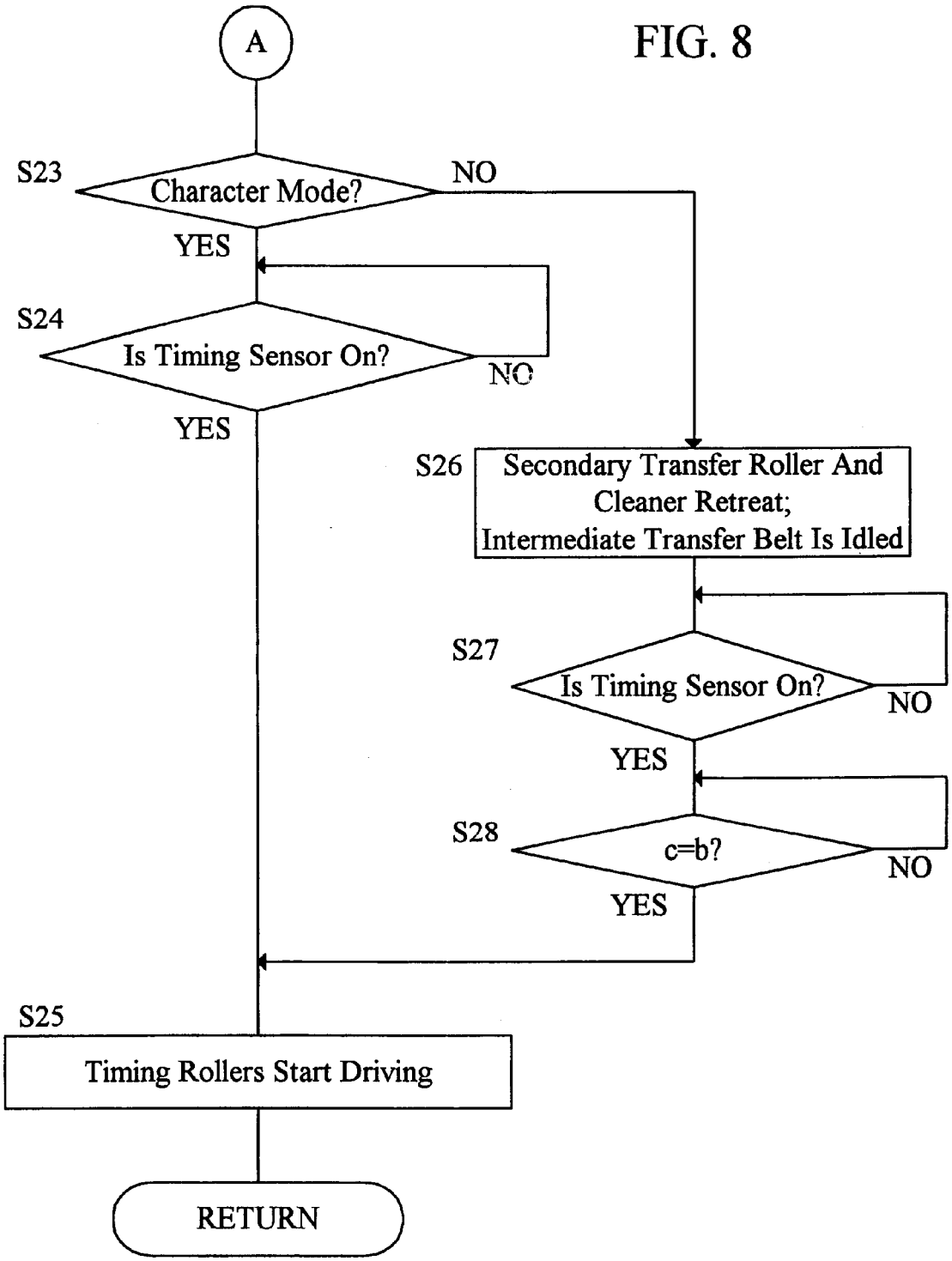
FIG. 8 is a flow chart showing still another control operation performed by the controller following the operation shown in FIG. 5.

Instead of the control operation shown in FIG. 6, another control operation as shown in FIG. 8 may be employed.

If it is judged, through the above-described steps S6 and S12, that, relative to the position of the toner image on the intermediate transfer belt 12, the sheet S is delayed, due to a slip for example, in reaching the paired timing rollers 48 beyond the allowable period of time, it is judged, based on inputted image signals, whether the toner image I on the intermediate transfer belt 12 is an image of a character mode or not (step S23). If the image is of the character mode, it is expected that a relatively large margin, which corresponds to the distance d, can be provided in the sheet S. In this case, therefore, the toner image I on the intermediate transfer belt 12 can be transferred onto the sheet S without protruding outward of the sheet, although it may be transferred at a position slightly deviated from the predetermined position, thereby reducing the width of the margin. Therefore, the controller 70 judges that a condition for transferring the image on the sheet S is met. In this case, as soon as the sheet S reaches the paired timing rollers 48 (step S24), the paired timing rollers 48 are driven (step S25) for transporting the sheet S to the transfer region 36. As a result, the toner image I on the intermediate transfer belt 12 is transferred on the sheet S without protruding outward from the sheet.

If, in the above-described step S23, the toner image I is found to of a mode other than the character mode, i.e., of a photo mode for example, the sheet S cannot be transported in time for the image transfer operation even if the paired timing rollers 48 continue to transport the sheet S toward the transfer region 36, because a photo image or the like generally allows a relatively small margin on the sheet. In this case, therefore, if the toner image I is transferred, it protrudes outward of the sheet S. Therefore, the controller 70 judges that a condition for transferring the image on the sheet S is not met.

In this case, as shown in FIG. 3A, the secondary transfer roller 34 and the cleaner 38 are retreated from the intermediate transfer belt 12, and the intermediate transfer belt 12 carrying the toner image I thereon is idled at least about one revolution without transferring the toner image I (step S26). Subsequently, when the sheet S reaches the paired timing rollers 48 (step S27), in synchronism with the toner image I on the intermediate transfer belt 12 (step S28), the paired timing rollers 48 are started to be driven (step S25). At this time, the secondary transfer roller 34 and the cleaner 38 recover their original positions, as shown in FIG. 3B. Thus, the toner image I on the intermediate transfer belt 12 is transferred at a predetermined position of the sheet S in the transfer region 36.

Also with this control, it is possible to transfer the toner image I onto the sheet S even when the feeding of the sheet S is delayed due to a slip for example. Thus, it is possible to continue the image forming operation even under a condition which has conventionally forced the operation of the apparatus to stop. As a result, it is possible to prevent the image forming efficiency to be deteriorated and to prevent the image forming material and sheets from being wasted.

Although a so-called tandem type image forming apparatus is exemplarily described in the above-described embodiments, the present invention is not limited to this. For example, the present invention is also applicable to an image forming apparatus as shown in FIG. 9, in which a rotary shifting developing device is employed which includes rotatably carried four developer units for respective colors for sequentially forming images of respective colors on an photosensitive drum, and the obtained image is transferred onto an intermediate transfer belt, thereby performing full color printing.

Further, instead of a belt, an intermediate transfer member having another configuration such as a drum may be employed for the present invention.

Moreover, although a printer is exemplarily described in the above-described embodiments, the present invention is not limited to this. The present invention may be applicable to other image forming apparatus such as a printer, a copying machine, a facsimile machine, or a multi function apparatus in which these devices and a printer are integrally built in.

With an image forming apparatus according to the embodiments of the present invention, it is judged whether or not a condition for transferring or fixing an image on a sheet is met and the image forming operation is controlled based on the judgment. Therefore, even when the feeding of a sheet to a transferring section is delayed due to a slip for example relative to the image on the intermediate transfer member for example, it is possible to appropriately transfer the image on the sheet. Therefore, it is possible to continue the image forming operation even under a condition which has conventionally forced the operation of apparatus to stop. As a result, it is possible to prevent the image forming efficiency to be deteriorated and to prevent the image forming material and sheets from being wasted.

Obviously, many modifications and variation of the present invention are possible in light of the above teachings. It is therefore to be understood that within the scope of the appended claims, the invention may be practiced other than as specifically described.

What is claimed is:

1. An image forming apparatus, comprising:

a rotatable intermediate transfer member;

an image forming device for forming a toner image of different color images on the intermediate transfer member;

a transferring device for transferring the toner image formed on the intermediate transfer member onto a sheet;

a fixing device for fixing the toner image transferred on the sheet to the sheet; and an image forming operation controller for judging whether a condition for transferring or fixing an image on the sheet is met and for controlling an image forming operation based on the judgement, wherein the image forming operation controller controls the operation to idle the intermediate transfer member when the image forming operation controller judges that it is impossible, due to a delay in feeding the sheet, to transfer the image at a predetermined position on the sheet.

2. The image forming apparatus according to claim 1, when the image forming operation controller judges that the condition is not met, the image forming operation controller controls the operation so that the intermediate transfer member carrying the image formed thereon by the image forming device idles at least about one revolution without transferring the image.

3. The image forming apparatus according to claim 2, wherein the condition is that the image forming operation controller judges that a thick paper or an OHP film sheet having a larger thickness than an ordinary paper is fed although an instruction for printing on an ordinary paper is given.

4. The image forming apparatus according to claim 3, wherein the image forming operation controller controls the operation to reduce, during the idling of the intermediate transfer member, a rotation speed of the intermediate transfer member and a fixing speed of the fixing device.

5. The image forming apparatus according to claim 3, wherein, during the idling of the intermediate transfer member, the image forming operation controller controls the operation to raise a fixing temperature of the fixing device.

6. The image forming apparatus according to claim 2, when the image forming operation controller judges that it is impossible, due to a delay in feeding of the sheet, to transfer the image at a predetermined position on the sheet, the image forming operation controller controls the operation to idle the intermediate transfer member.

7. The image forming apparatus according to claim 2, when the image forming operation controller judges that, due to a delay in feeding of the sheet, the image protrudes outward of the sheet if transferred on the sheet, the image forming operation controller controls the operation to idle the intermediate transfer member.

8. The image forming apparatus according to claim 1, wherein a timing of the image forming condition judgment is after a print start instruction is given and before the image is transferred.

9. The image forming apparatus according to claim 1, wherein the image forming device has a plurality of image forming units, which are arranged along the intermediate transfer member, each for forming an image of a different color on the intermediate transfer member.

10. The image forming apparatus according to claim 1, wherein the image forming device has a plurality of developer units, which are provided in a rotary shifting developing device, each for forming an image of a different color on the intermediate transfer member.

11. An image forming apparatus, comprising:

a rotatable intermediate transfer member;

an image forming device for forming a toner image of different color images on the intermediate transfer member;

a transferring device for transferring the toner image formed on the intermediate transfer member onto a sheet;

a fixing device for fixing the toner image transferred on the sheet to the sheet; and an image forming operation controller for judging whether a condition for transferring or fixing an image on the sheet is met and for controlling an image forming operation based on the judgement, wherein when the image forming operation controller judges that the condition is not met, the image forming operation controller controls the operation so that the intermediate transfer member carrying the image formed thereon by the image forming device idles at least one revolution without transferring the image, and when the image forming operation controller judges that the feeding of the sheet is delayed and that the image formed by the image forming device is an image of a mode other than a character mode, the image forming operation controller controls the operation to idle the intermediate transfer member.

12. An image forming apparatus, comprising:

a rotatable intermediate transfer belt;

a plurality of image forming units each for forming an image of a different color on the intermediate transfer belt;

a transferring device for transferring the image formed on the intermediate transfer belt onto a recording medium; and a controller for judging whether a condition for transferring an image on the recording medium is met and for controlling an image forming operation based on the judgement, wherein the controller controls the operation to idle the intermediate transfer belt when the controller judges that it is impossible, due to a delay in feeding the sheet, to transfer the image at a predetermined position on the recording medium.

13. The image forming apparatus according to claim 12, when the controller judges that the condition is not met, the controller controls the operation so that the intermediate transfer member carrying the image formed thereon by the image forming device idles at least about one revolution without transferring the image.

* * * * *